US008818215B2

(12) United States Patent
Kihara et al.

(10) Patent No.: US 8,818,215 B2
(45) Date of Patent: Aug. 26, 2014

(54) IMAGE FORMING APPARATUS FOR OUTPUTTING A SIGNAL CORRESPONDING TO AN AMOUNT OF A DEVELOPER

(75) Inventors: Takayoshi Kihara, Mishima (JP); Hideaki Hasegawa, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 161 days.

(21) Appl. No.: 13/529,376

(22) Filed: Jun. 21, 2012

(65) Prior Publication Data

US 2012/0328309 A1 Dec. 27, 2012

(30) Foreign Application Priority Data

Jun. 23, 2011 (JP) ..... 2011-139657
Jun. 7, 2012 (JP) ..... 2012-129774

(51) Int. Cl.
*G03G 15/00* (2006.01)

(52) U.S. Cl.
USPC ..... 399/35

(58) Field of Classification Search
USPC ..... 399/35, 120, 231, 253, 297
See application file for complete search history.

(56) References Cited

U.S. PATENT DOCUMENTS 4,545,325 A * 10/1985 Komatsu et al. ..... 399/231
4,618,243 A * 10/1986 Knapp ..... 399/231
5,253,022 A 10/1993 Takeuchi et al.
5,255,062 A * 10/1993 Oka et al. ..... 399/231
5,283,615 A * 2/1994 Yokoyama et al. ..... 399/231
6,434,348 B1 * 8/2002 Tomizawa ..... 399/66
6,473,574 B1 10/2002 Usui et al.
6,721,522 B2 * 4/2004 Kakeshita ..... 399/150
7,877,033 B2 * 1/2011 Shibuya ..... 399/66
8,190,044 B2 5/2012 Kitamura et al.
2006/0088343 A1 * 4/2006 Watanabe et al. ..... 399/297
2010/0074659 A1 * 3/2010 Shimmura ..... 399/301

FOREIGN PATENT DOCUMENTS

JP 2001324855 A * 11/2001
JP 2004-240369 A 8/2004
JP 2005017337 A * 1/2005
JP 2006-251508 A 9/2006

* cited by examiner

*Primary Examiner* — Quana M Grainger
(74) *Attorney, Agent, or Firm* — Fitzpatrick, Cella, Harper & Scinto

(57) ABSTRACT

An image forming apparatus includes image forming portions provided along a movement direction of a recording material conveying member or an intermediary transfer member and including a first portion and a second portion provided downstream of the first portion with respect to the movement direction; a detecting portion for detecting information on a developer deterioration state at the first portion; a storing portion for storing a relationship between a detection result of the detecting portion and an amount of the developer to be back-transferred at the second portion; and an outputting device for outputting a signal relating to an amount of the developer accommodated in the accommodating portion at the second portion on the basis of the detection result of the detecting portion, the relationship stored in the storing portion, and information on the developer used for image formation at each of the first and second portions.

10 Claims, 7 Drawing Sheets

(a)

(b)

IMAGE FORMING APPARATUS FOR OUTPUTTING A SIGNAL CORRESPONDING TO AN AMOUNT OF A DEVELOPER

FIELD OF THE INVENTION AND RELATED ART

The present invention relates to an image forming apparatus, such as a copying machine or a printer, having a function of forming an image on a recording material by an electrophotographic process, an electrostatic recording process, or the like.

In recent years, image forming apparatuses of the electrophotographic type have advanced in speed-up, function improvement and color image formation, so that various types of image forming apparatuses such as a copying machine, a printer and a facsimile machine are commercialized.

In recent years, not only is the image high quality but also the image can be printed on a large number of sheets. In addition, environment conditions and recording materials used have diversified with an enlargement of the market and therefore the image forming apparatus is strongly required to provide a stable image while meeting these demands. Of these image forming apparatuses, an image forming apparatus capable of forming the image at high speed and an in-line type image forming apparatus, in which a plurality of image forming units for forming a plurality of toner images different in color are juxtaposed in line in a conveyance direction of the recording material carried on a transfer belt as a recording material conveying member and the toner images are successively transferred superposedly from a plurality of image bearing members onto the recording material, have been known.

Other than these image forming apparatuses there is a type of image forming apparatus in which the plurality of image forming units for forming toner images different in color are juxtaposed in line in a member direction of an intermediary transfer belt which acts as an intermediary transfer member. In this type, the toner images are successively transferred superposedly from the plurality of image bearing members onto the intermediary transfer belt and then are collectively transferred from the intermediary transfer belt onto the recording material.

In such image forming apparatuses, a residual toner container (accommodating container) for collecting a residual toner remaining on the image bearing member is provided at each of the plurality of image forming units. Further, as a residual toner amount detecting means, a detecting mechanism, such as an optical sensor, for detecting an amount of the residual toner collected in the residual toner container is provided in some cases. In the case where the amount of the residual toner collected in the residual toner container exceeds a certain amount, it is possible to determine that the residual toner container is full.

Further, by obtaining an amount of use of each color toner from image data (image information) of an associated color component, in the case where an integrated value of the toner use amount exceeds the certain amount, it is possible to determine that the residual toner container at the image forming unit is full (U.S. Pat. No. 6,473,574 and Japanese Laid-Open Patent Application (JP-A) 2006-251508).

Further, there is also a technique in which a plurality of density detecting sensors are provided and from its detection result, a transfer efficiency and a back-transfer efficiency are calculated and then near detection of the residual toner amount is made (JP-A 2004-240369).

However, it would be considered that the residual toner amount cannot be detected with high accuracy in some cases only by obtaining the amount of use of each of the color toners from the image data of each of the color components.

In order to estimate the residual toner amount with high accuracy, it would be considered that there is a need to consider also a deterioration state of the toner depending on a degree of use of each image forming unit, a back-transfer amount of the toner generated during passing of the toner through downstream stations, and the like.

On the other hand, in order to consider the transfer efficiency and the back-transfer efficiency, in the case where the detecting mechanism such as a density sensor is provided, there is a need to dispose a plurality of detecting mechanisms and therefore there is a possibility that an increase in cost is caused.

SUMMARY OF THE INVENTION

The present invention has been accomplished in view of the above-described circumstances.

A principal object of the present invention is to provide an image forming apparatus capable of improving detection accuracy of a full-up condition of an accommodating container for accommodating a residual toner by estimating an amount of the residual toner with high accuracy without causing an increase in cost.

According to an aspect of the present invention, there is provide an image forming apparatus comprising: a plurality of image forming portions each including an image bearing member, a developing device for developing into a developer image an electrostatic latent image formed on the image bearing member, and a cleaning device for collecting in an accommodating container a developing device remaining on the image bearing member after the developer image is transferred, wherein the plurality of image forming portions are provided along a movement direction of a recording material conveying member for conveying a recording material onto which the developer image is to be transferred or an intermediary transfer member onto which the developer image is to be transferred, and include a first image forming portion and a second image forming portion provided downstream of the first image forming portion with respect to the movement direction of the recording material conveying member or the intermediary transfer member; detecting means for detecting information on a developer deterioration state at the first image forming portion; storing means for storing a relationship between a detection result of the detecting means and an amount of the developer to be back-transferred at the second image forming portion; and an outputting device for outputting a signal relating to an amount of the developer accommodated in the accommodating portion at the second image forming portion on the basis of the detection result of the detecting means, the relationship stored in the storing means, information on the developer used for image formation at the first image forming portion, and information on the developer used for image formation at the second image forming portion.

These and other objects, features and advantages of the present invention will become more apparent upon a consideration of the following description of the preferred embodiments of the present invention taken in conjunction with the accompanying drawings.

Figure 5:
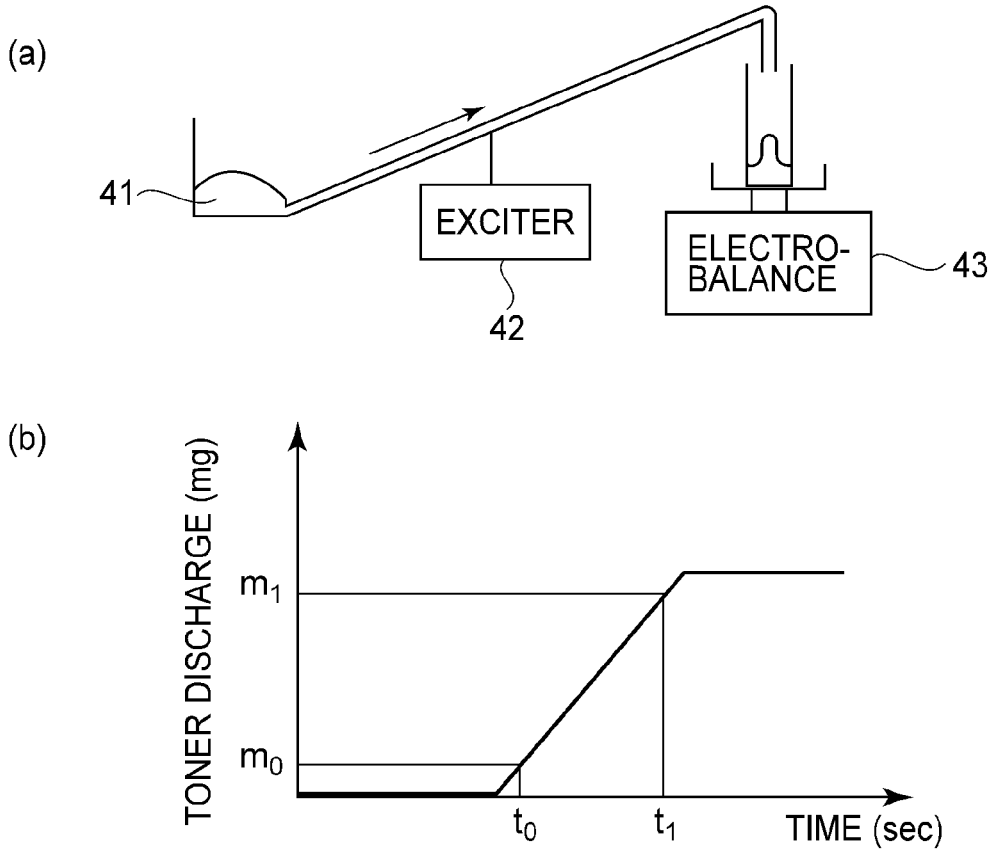

Parts (a) and (b) of FIG. 5 are a schematic view and a graph, respectively, for illustrating measurement of a toner transfer rate in Embodiment 1.

Figure 6:
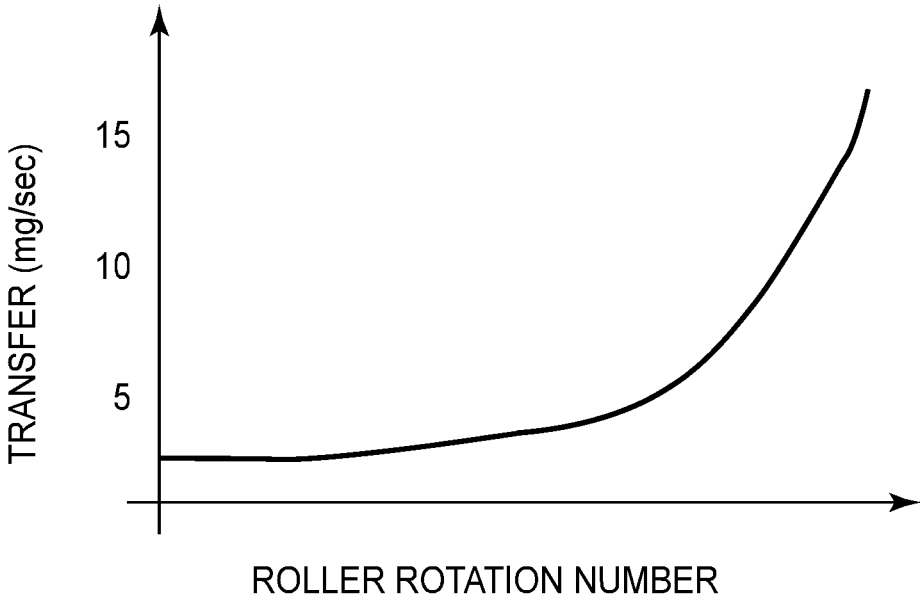

FIG. 6 is a graph showing a relationship between a rotation number of a developing roller and the toner transfer rate.

Figure 7:
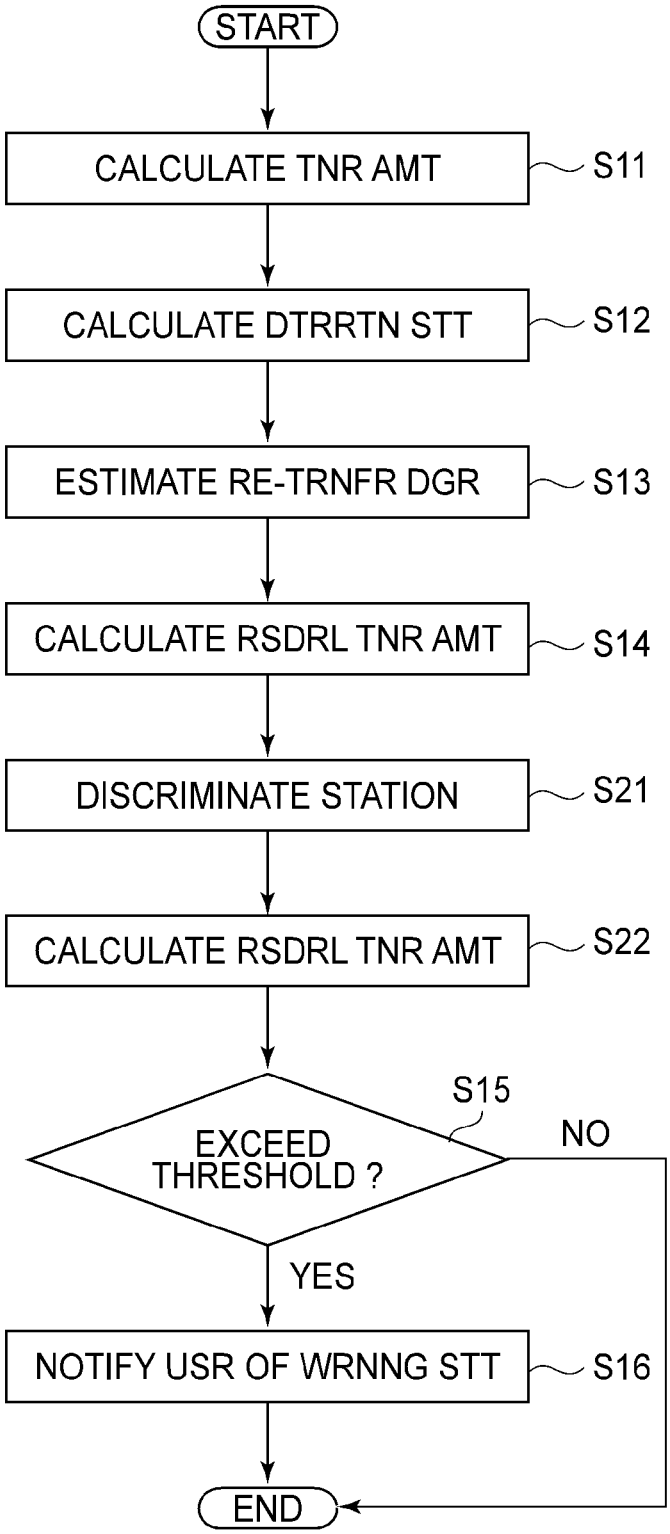

FIG. 7 is a flow chart showing an execution procedure of detection of full of a residual toner in Embodiment 2.

Figure 8:
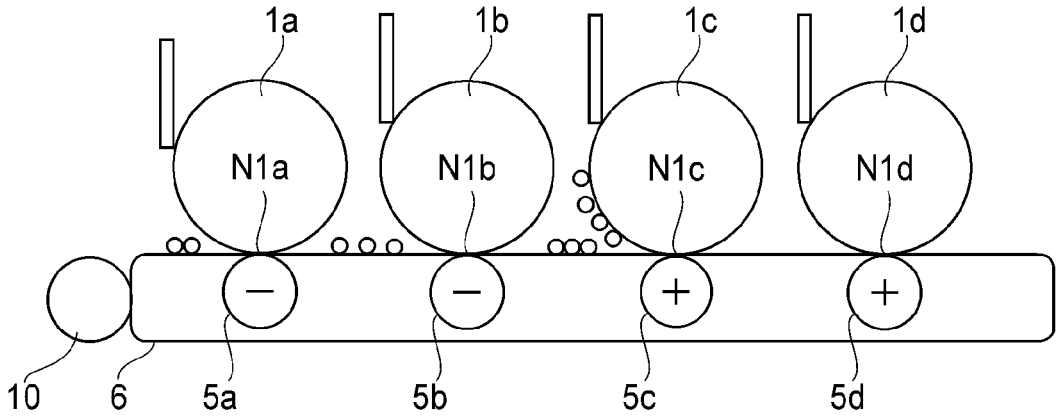
Figure 8:
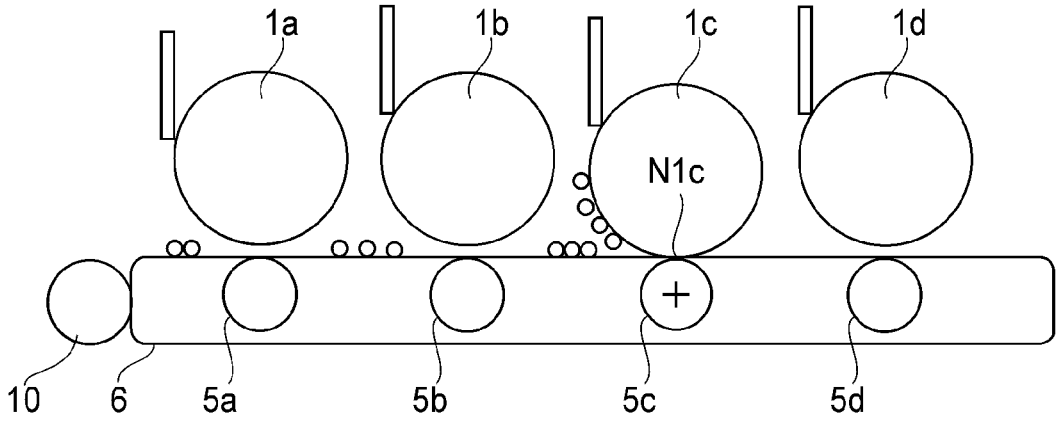

Parts (a) and (b) of FIG. 8 are schematic sectional views for illustrating control of collection destination of a transfer residual toner in Embodiment 2.

DESCRIPTION OF THE PREFERRED EMBODIMENTS

Hereinbelow, preferred embodiments of the present invention will be exemplarily and specifically described with reference to the drawings. However, dimensions, materials, shapes, relative arrangements and the like of constituent elements described in the following embodiments are appropriately changed depending on constitutions or various conditions of apparatuses to which the present invention is applied and thus the scope of the present invention is not limited thereto.

[Embodiment 1 ]

Figure 1:
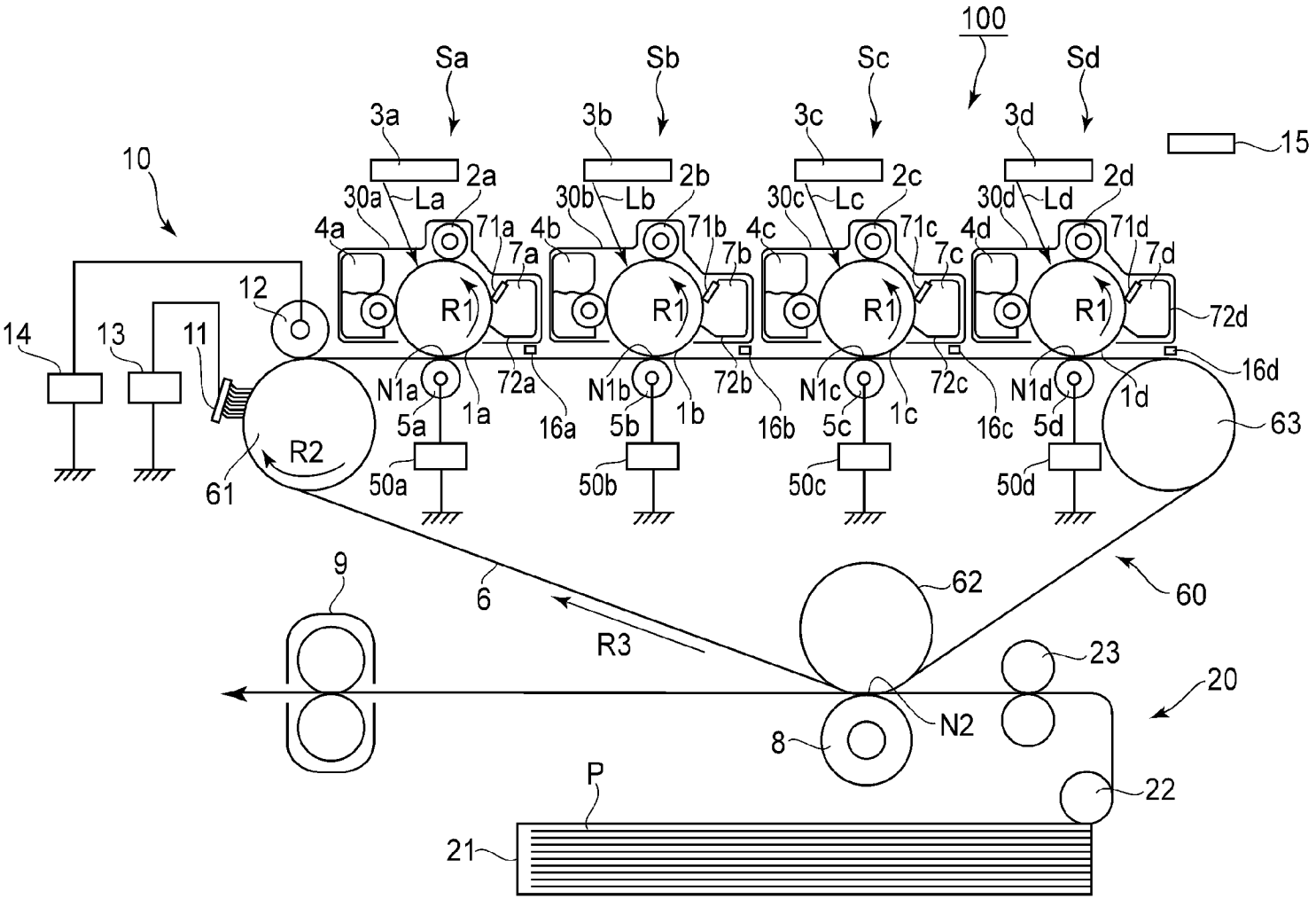
FIG. 1 is a schematic sectional view showing a general structure of an image forming apparatus in Embodiment 1.

FIG. 1 is a schematic sectional view showing a general structure of a four-color based full-color laser beam printer as an image forming apparatus in this embodiment.

<1. General Structure of Image Forming Apparatus>

First, a general structure of the image forming apparatus in this embodiment will be described with reference to FIG. 1. An image forming apparatus 100 in this embodiment is an electrophotographic full-color laser beam printer. The image forming apparatus 100 is of an in-line type using an intermediary transfer system. That is, the image forming apparatus 100 sequentially forms a plurality of color toner image (developer images) based on image information obtained by separating an intended image into a plurality of color components. Then, the image forming apparatus 100 primary-transfers the color toner images superposedly onto an intermediary transfer member and then secondary-transfers the color toner image collectively onto the recording material to obtain a recorded image.

The image forming apparatus 100 includes a plurality of image forming stations, more specifically, the first, second, third and fourth image forming stations (process stations) Sa, Sb, Sc and Sd, which are for forming yellow (Y), magenta (M), cyan (C) and black (K) toner images, respectively. As shown in FIG. 1, the first to fourth stations Sa to Sd are provided and arranged along a movement direction of an intermediary transfer belt 6 as the intermediary transfer member.

The stations Sa-Sd in this embodiment are roughly the same in structure and operation. Therefore, unless they need to be differentiated, they will be described collectively without using the suffixes a, b, c and d of reference numerals or symbols which are used in the drawing to indicate the color of the monochromatic images.

Each station S of the image forming apparatus 100 includes a photosensitive drum 1, which is an electrophotographic photosensitive member 1 in the form of a drum, as an image bearing member. The photosensitive drum 1 is rotationally driven by a driving means (unshown) in the direction (counterclockwise direction) indicated by an arrow R1. The (peripheral) surface of the photosensitive drum 1 is uniformly charged by a charging roller 2 (primary charging device) as a charging means. Then, a beam of laser light L is projected, while being modulated with the image information, from an exposure apparatus 3 onto the photosensitive drum 1 (the image bearing member) to form an electrostatic latent image (electrostatic image) on the photosensitive drum 1. When the surface of the photosensitive drum 1 is advanced further in the direction R1, the electrostatic latent image formed on the photosensitive drum 1 in accordance with the image information is developed by a developing device 4, as a developing means, into a visible image, that is, a toner image. The developing device 4 develops the latent image on the photosensitive drum 1 by a reversal developing method. That is, the developing device 4 develops the latent image by depositing toner (developer) of the same polarity as that (which is negative in this embodiment) of the photosensitive drum 1 on an image portion (exposed portion), of the uniformly charged photosensitive drum 1, which has been reduced in potential level by the exposure.

The intermediary transfer belt 6 is provided downstream of a developing position with respect to a surface movement direction of the photosensitive drum 1 indicated by the arrow R1.

The intermediary transfer belt 6 is a cylindrical and endless film, which is stretched around three rollers consisting of a driving roller 61, a secondary transfer opposite roller 62 and a tension roller 63. As the driving roller 61 is rotationally driven in the direction indicated by an arrow R2 in the drawing (clockwise direction), the intermediary transfer belt 6 circularly moves (rotates) in the direction indicated by an arrow R3 in the drawing, at roughly the same speed as the speed at which the peripheral surface of the photosensitive drum 1 moves (peripheral speed).

A primary transfer roller 5 as a primary transfer means (primary transfer member) is provided at a portion when it opposes the photosensitive drum 1 via the intermediary transfer belt 6. The primary transfer roller 5 urges intermediary transfer belt 6 toward the photosensitive drum 1 to form a primary transfer portion N1 (primary transfer nip) in which the photosensitive drum 1 and the intermediary transfer belt 6 contact each other.

The intermediary transfer belt 6 stretched around the driving roller 61, the secondary transfer opposite roller 62 and the tension roller 63, and the primary transfer rollers 5*a*-5*d*, etc., constitutes an intermediary transfer unit 60.

As the photosensitive drums 1 and intermediary transfer belt 6 are rotated, the toner image formed on the photosensitive drum 1 is transferred (primary-transferred) onto the outer peripheral surface of the intermediary transfer belt 6 by the action of the primary transfer roller 5. During this process, a primary transfer bias (voltage) which is opposite (positive in this embodiment) in polarity to the normal charge polarity of the toner, is applied to the primary transfer roller 5 from a primary transfer power source 50 as a means for supplying a primary transfer voltage. Thus, during the primary transfer step, an electric field, which moves the normally charged toner from the photosensitive drum 1 onto the intermediary transfer belt 6 is formed at the primary transfer portion N1.

Also during the primary transfer step, a residual toner remaining on the photosensitive drum 1 without being transferred onto the intermediary transfer belt 6 is removed by a cleaning device 7 as a means for cleaning the photosensitive drum 1. The cleaning device 7 has a cleaning blade 71, which is a cleaning member formed of a plate-like elastic member disposed so as to contact the surface of the photosensitive drum 1. The cleaning device 7 is also provided with a cleaned toner container (residual toner container) 72 for cleaning the toner removed from the peripheral surface of the photosensitive drum 1 by the cleaning blade 71.

The image forming operation constituted by the above-described charging, exposure, development, and primary transfer steps is carried out in each of the first to fourth stations Sa-Sd for yellow, magenta, cyan and black colors in this order from the upstream side with respect to the surface movement direction of the intermediary transfer belt 6. As a result, the plurality of color toner images are superposedly formed on the intermediary transfer belt 6. For example, in the case where a full-color image is to be formed, four color toner images of yellow, magenta, cyan and black are formed.

A secondary transfer roller 8, which is a secondary transfer member as a secondary transfer means, is disposed at a position where it opposes the secondary transfer opposite roller 62 via the intermediary transfer belt 6. The secondary transfer roller 8 is urged toward the secondary transfer opposite roller 62 via the intermediary transfer belt 6 to form a secondary transfer portion N2 (secondary transfer nip) in which the intermediary transfer belt 6 and the secondary transfer roller 8 contact each other.

The toner images on the intermediary transfer belt 6 are transferred (secondary-transferred) onto the recording material P by the action of the secondary transfer roller 8. More specifically, at a recording material feeding portion 20, the recording material P accommodated in a cassette 21 is fed by a feed roller 22 and then is supplied with predetermined timing by registration rollers 23 to the secondary transfer portion N2 in which the intermediary transfer belt 6 and the secondary transfer roller 8 contact each other. Substantially at the same time, to the secondary transfer roller 8, a secondary transfer bias, which is opposite (positive in this embodiment) to that of the normally charged toner, is applied from a secondary transfer power source (unshown) as a means for supplying the secondary transfer roller 8 with the secondary transfer voltage. As a result, an electric field, which causes the normally charged toner to transfer from the intermediary transfer belt 6 onto the recording material P, is formed in the secondary transfer portion N2 during the secondary transfer step.

The transfer residual toner remaining on the intermediary transfer belt 6 without being transferred onto the recording material P during the secondary transfer step is uniformly scattered by a cleaning brush 11 as a first charging member. Then, charge is given to the transfer residual toner by a cleaning roller 12 as a second charging member.

To the cleaning brush 11, a first cleaning power source 13 (first power source or high voltage source) as a first cleaning voltage supplying means is connected. To the cleaning roller 12, a second cleaning power source 14 (second power source or high voltage source) as a second cleaning voltage supplying means is connected. The cleaning brush 11, the cleaning roller 12, the first cleaning power source 13, and the second cleaning power source 14 constitute an intermediary transfer member cleaning means 10. With respect to the surface movement direction of the intermediary transfer belt 6, both the cleaning brush 11 and the cleaning roller 12 are disposed downstream of the secondary transfer portion N2 and upstream of the primary transfer portion of the first station Sa. In this embodiment, therefore, the cleaning brush 11 and the cleaning roller 12 charge the transfer residual toner (belt residual toner) remaining on the intermediary transfer belt 6 after the secondary transfer, in the upstream side of the first transfer portion N1*a* of the first station Sa. Particularly, with respect to the surface movement direction of the intermediary transfer belt 6, the cleaning brush 11 is disposed upstream of the cleaning roller 12.

The transfer residual toner charged by the cleaning roller 12 is transferred back onto the photosensitive drum 1*a* in the first station Sa during a subsequent primary transfer step (simultaneous transfer and cleaning). Further, the transfer residual a toner deposited on the photosensitive drum 1*a* by being transferred back from the intermediary transfer belt 6 onto the photosensitive drum 1*a* is removed from the photosensitive drum 1*a* by the cleaning device 7*a*, thus being collected.

In this embodiment, the photosensitive drum 1, and process means acting on the photosensitive drum 1, including the charge roller 2, the developing apparatus 4, and the cleaning device 7 constitute an integral process cartridge 30 and is detachably mountable to the main assembly of the image forming apparatus 100.

<2. Primary Transfer Roller>

The primary transfer roller 5 is an elastic roller, which is $10^5$-$10^9$ Ω·cm in volume resistivity, and 30 deg. in rubber hardness (measured by Asker C hardness meter). It is pressed against the photosensitive drum 1 under a total pressure of roughly 9.8 N via the intermediary transfer belt 6. It is rotated by the rotation of the intermediary transfer belt 6. Further, a voltage of −2.0 to +3.5 kV can be applied to the primary transfer roller 5 from a primary transfer power source 50 (high voltage power source).

<3. Intermediary Transfer Belt>

The intermediary transfer belt 6 is formed of a 100 μm-thick film of polyvinylidene fluoride (PVDF), which has been adjusted to $10^{11}$ Ω·cm in volume resistivity by mixing therein an electroconductive agent. Further, the intermediary transfer belt 6 is stretched by the rollers consisting of the driving roller 61, the secondary transfer opposite roller 62 and the tension roller 63 and is under application of tension of roughly 60 N in total pressure applied by the tension roller 63.

<4. Secondary Transfer Roller>

The secondary transfer roller 8 is an elastic roller, which is $10^5$-$10^9$ Ω·cm in volume resistivity, and 30 deg. in rubber hardness (measured by Asker C hardness meter). It is pressed against the secondary transfer opposite roller 62 with a total pressure of roughly 39.2 N via the intermediary transfer belt 6.

It is rotated by the rotation of the intermediary transfer belt 6. Further, a voltage of −2.0 to +4.0 kV of voltage can be applied to the secondary transfer roller 8 from a secondary transfer power source (high voltage power source) (unshown).

<5. Cleaning Brush>

The cleaning brush 11 is a brush formed of substantially dense nylon fibers which are $10^6$-$10^9$ Ω·cm in electroconductivity. The cleaning brush 11 in this embodiment is fixedly disposed. In this embodiment, an end position of the cleaning brush 11 is set so that the amount of penetration of the tip of the cleaning brush 11 into the intermediary transfer belt 6 is 1.0 mm. Further, the cleaning brush 11 is pressed against the driving roller 61 via the intermediary transfer belt 6. The length in the longitudinal direction (direction perpendicular to the surface movement direction of the intermediary transfer belt 6) of the cleaning brush 11 is roughly the same as the width in the same direction of an image formable region of the intermediary transfer belt 6.

Thus, with the movement of the intermediary transfer belt 6, the cleaning brush 11, which is located upstream of the cleaning roller 12 with respect to the surface movement direction of the intermediary transfer belt 6, rubs the surface of the intermediary transfer belt 6. Further, a voltage of −2.0 to +2.0 kV can be applied to the cleaning brush 11 from the first cleaning power source 13 (high voltage power source).

<6. Cleaning Roller>

The cleaning roller 12 is an elastic roller, which is $10^5$-$10^9$ Ω·cm in volume resistivity. It is pressed against the drive roller 61 via the intermediary transfer belt 6. It is rotated by the rotation of the intermediary transfer belt 6. With respect to the longitudinal direction (rotational axis direction or the direction perpendicular to the surface movement direction of the surface of the intermediary transfer belt 6), the length of the cleaning roller 12 is roughly the same as the width in the same direction of the image formable region of the intermediary transfer belt 6.

As described above, the cleaning roller 12 located downstream of the cleaning brush 11 with respect to the surface movement direction of the intermediary transfer belt 6 moves in the same direction as the intermediary transfer belt in a contact region in which it is in contact with the intermediary transfer belt 6. Further, a voltage of −2.0 to +2.0 kV can be applied to the cleaning roller 12 from the second cleaning power source 14 (high voltage power source).

<7. Cleaning of Intermediary Transfer Member>

Next, the method for cleaning the intermediary transfer belt 6 will be described in detail.

In this embodiment, the first and second charging members for the intermediary transfer member cleaning means 10 are structured as follows. That is, in this embodiment, the cleaning brush 11 as the first charging member is a stationary member positioned to rub the surface of the intermediary transfer belt 6. On the other hand, the cleaning roller 12 as the second charging member is a rotational member which rotates in contact with the intermediary transfer belt 6 in the same direction as that of the intermediary transfer belt 6. By such a constitution, the toner scattered by the first charging member is charged by the second charging member.

Figure 2:
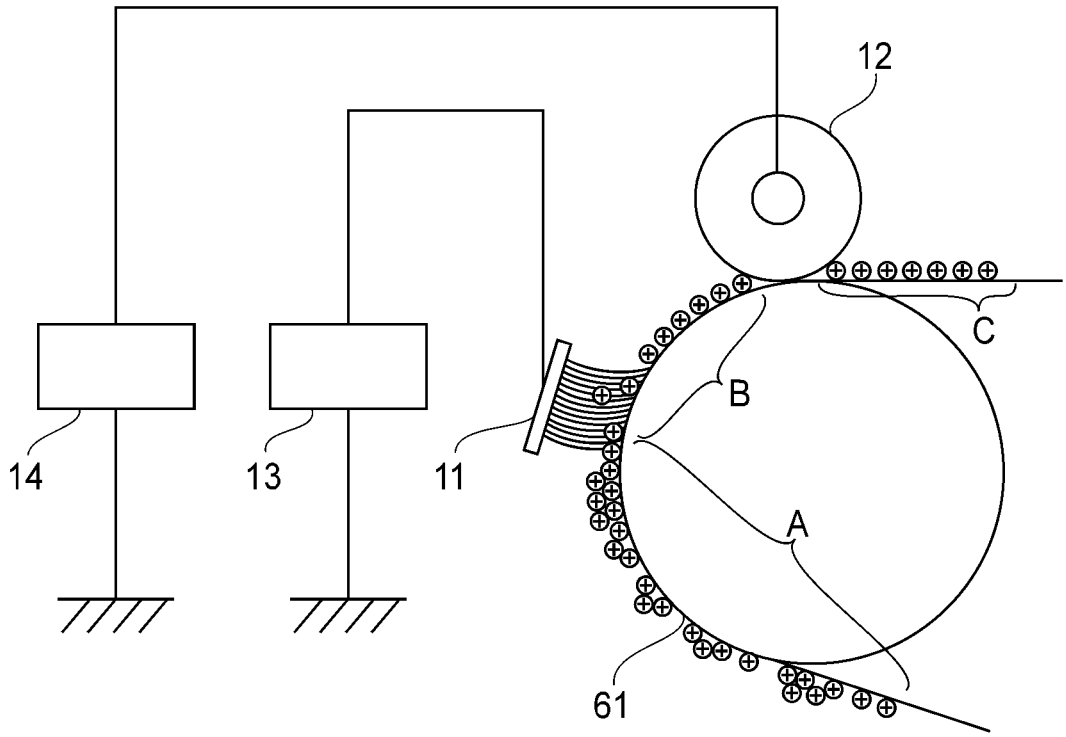
FIG. 2 is a schematic view for illustrating a cleaning method of an intermediary transfer belt in Embodiment 1.

The cleaning method of the intermediary transfer belt 6 will be described in further detail. FIG. 2 is a schematic view for illustrating the cleaning method of the intermediary transfer belt 6 and is a schematic enlarged sectional view of the cleaning bush 11, the cleaning roller 12, and their adjacencies.

The toner is negatively charged by the developing apparatus 4, and the image formation is effected by applying positive bias to the primary transfer roller 5 and the secondary transfer roller 8 from the high voltage power sources. Therefore, the transfer residual toner which remains on the intermediary transfer belt 6 after the secondary transfer step has both the positive and negative charge polarities by the influence of the positive bias applied to the secondary transfer roller 8, as shown at A in FIG. 2.

Therefore, the bias of opposite polarity to the normal charge polarity of the toner, i.e., of the positive polarity is applied from the first cleaning power source 13 to the cleaning brush 11 located upstream of the cleaning roller 12 with respect to the surface movement direction of the intermediary transfer belt 6.

As a result, when the transfer residual toner on the intermediary transfer belt 6 passes through the cleaning brush 11 and intermediary transfer belt 6, the transfer residual toner is charged to the positive polarity. The transfer residual toner which is not completely positively charged is partly collected by the cleaning brush 11 (at B in FIG. 2).

Next, the bias of the opposite polarity to the normal charge polarity of the toner, i.e., the positive polarity, is applied from the second cleaning power source 14 to the cleaning roller 12 located downstream of the cleaning brush 11 with respect to the surface movement direction, of the intermediary transfer belt 6. Thus, when the transfer residual toner on the intermediary transfer belt 6 passes through the cleaning roller 12, the optimum amount of positive charge for realizing the simultaneous transfer and cleaning can be imparted to the transfer residual toner (at C in FIG. 2).

Thereafter, the transfer residual toner to which the optimum positive electric charge is imparted is collected by the photosensitive drum 1*a* by being transferred back onto the photosensitive drum 1*a* at the primary transfer portion N1*a* of the first station Sa.

<8. Back-Transfer Phenomenon>

A back-transfer phenomenon will be described below. The back-transfer is such a phenomenon that the toner image formed on the intermediary transfer belt 6 at the station, where the image forming operation is performed, of the plurality of stations is transferred back onto the photosensitive drum 1 when the toner image passes through the station downstream of the station (where the image forming operation is performed). Here, the station where the image forming operation is performed corresponds to a first image forming portion and the downstream station corresponds to a second image forming portion. The second image forming portion is disposed adjacent to and downstream of the first image forming portion with respect to the movement direction of the intermediary transfer belt 6.

Figure 4:
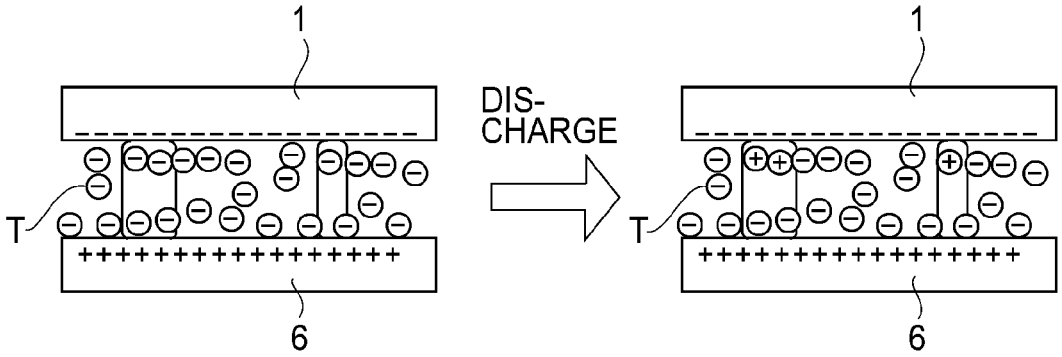
FIG. 4 is a schematic view of a nip formed between a photosensitive drum and the intermediary transfer belt in Embodiment 1.

With reference to FIG. 4, why the back-transfer occurs will be described.

FIG. 4 is a schematic view of a nip (contact portion) formed between the photosensitive drum 1 and the intermediary transfer belt 6.

The surface of the photosensitive drum 1 is negatively charged and to the intermediary transfer belt 6, the positive voltage is applied for attracting the toner, subjected to the development at the upstream station, onto the intermediary transfer belt 6. In the nip formed between the photosensitive drum 1 and the intermediary transfer belt 6, there can be the case where a gap in which a potential difference exceeds an electric discharge threshold is created.

When the electric discharge is caused, the positive electric discharge is applied to the toner on the photosensitive drum 1. The surface of the photosensitive drum 1 is negatively charged and therefore the toner to which the positive electric charge is applied in the downstream side of the nip is moved toward the photosensitive drum 1, so that the back-transfer occurs. With a larger contrast between the surface potential of the photosensitive drum 1 and the transfer voltage, the potential difference which exceeds the electric discharge threshold is liable to occur, so that the number of times of electric discharge is also increased and thus a back-transfer amount is also increased.

With respect to when the back-transfer occurs, there is a low possibility of the occurrence of the back-transfer in a toner state at an initial use, but in a toner state at a later stage of a durability test, a charging property of the toner is different and thus there is a different tendency of the developing and transfer characteristics, so that the possibility of the occurrence of the back-transfer is higher than at the initial stage. Further, also in the case where the toner images of the secondary colors or the like are superposedly transferred, the back-transfer amount is liable to be increased. Therefore, in this embodiment, by using a toner deterioration state, a back-transfer degree at the downstream station is estimated (derived).

<9. Toner Deterioration Degree>

A degree of use of process station and the toner deterioration state will be described.

An object of this embodiment is to detect the toner deterioration state by detecting a degree of use of the process station to effect, on the basis of its detection result, estimation control of the back-transfer degree at the downstream station, thus performing detection of a full amount of the residual toner with high accuracy.

Therefore, in this embodiment, as a developer deterioration state detecting means, a detecting means for detecting the degree of use of each station is provided. This detecting means is constituted so as to detect the number of rotation of the photosensitive drum 1 or the developing roller of the developing device 4.

The toner is continuously rubbed from the initial state by the photosensitive drum, the developing roller or the developing blade, so that an external additive tends to be liberated or buried into the toner surface. Particularly, at the later stage of the durability test, this tendency is advanced, so that the toner transfer rate is increased.

The toner transfer rate measurement is made by measuring a total flowing characteristic including various flowability inhibition factors of powder. That is, the toner transfer rate measurement is an effective means for estimating an objective physical amount by total analysis. The toner transfer rate is obtained by measuring and difference in frictional force and detect of agglomeration between toner particles, so that the surface state (interfacial state) which largely affects the flowability of the toner is measured.

Part (a) of FIG. 5 is a schematic view showing a structure of a toner transfer rate measuring device.

About 1 g of the toner as a sample 41 is conveyed on a conveying table connected to an exciter 42 and a toner transfer amount per unit time is measured by an electrobalance 43 or the like.

As the conveying table connected to the exciter 42, a device represented by a part feeder or the like is employed. The part feeder is constituted by an electromagnet and a leaf spring and generates vibration by amplifying a force, by the leaf spring, generated by ON/OFF of the electromagnet. This vibration can be provided with directionality by adjusting an angle of the leaf spring, so that a member (work) placed in a bowl can be conveyed in a certain direction. In this embodiment, this member is replaced with the toner, so that the toner transfer rate is measured.

Part (b) of FIG. 5 is a graph showing a relationship, for measuring the toner transfer rate, between a time and a toner discharge amount (weight).

Here, the toner transfer rate can be calculated by the following equation.

$$\begin{aligned}(\text{toner transfer rate}) &= (\text{toner discharge amount per unit time}) \\ &= (m_1 - m_0)/(t_1 - t_0)(\text{mg/sec})\end{aligned}$$

As a result of the measurement of the toner transfer rate, the above-described tendency was obtained in the initial state of the toner and the later stage state (of the durability test or the use) of the toner.

At the initial state, the amount of the external additive such as silica deposited on the toner is large and therefore the interfacial state is good and thus a lubrication property is also good, so that the frictional force is lowered. For that reason, the flowability is high and thus the toner transfer rate is low.

At the later (end) stage, by the liberation or burying of external additive such as silica, the frictional force is increased, so that the flowability is lowered and thus the toner transfer rate is increased.

FIG. 6 is a graph showing a relationship between the developing roller rotation number and the toner transfer rate.

An average of the toner transfer rate is about 1-3 mg/sec which is low in the initial state but is about 10-15 mg/sec in the end state of the durability test, so that it is understood that a physical state of the toner is clearly changed.

Therefore, the toner deterioration state can be detected by using the toner transfer rate as the toner deterioration degree. The relationship between the toner transfer rate and the back-transfer degree.

TABLE 1

| TTR*1 | 1-3 | 4-6 | 7-10 | 11-15 | 15 or more |
|---|---|---|---|---|---|
| RTD*2 | 1 | 2 | 3 | 4 | 5 |

*1"TTR" represents the toner transfer rate (mg/sec).
*2"RTD" represents the back-transfer degree.

In Table 1, the back-transfer degree refers to an estimated degree of back-transfer generated during the transfer at the downstream station after the calculation of the toner transfer rate. There is a tendency that the back-transfer degree is decreased with a lower toner transfer rate and is increased with a higher toner transfer rate. Therefore, on the basis of the toner transfer rate (toner deterioration degree), it is possible to estimate (derive) the back-transfer degree.

When the back-transfer degree is large, an addition amount of the residual toner amount is liable to be increased. In this embodiment, as the means for detecting the toner deterioration state, the developing roller rotation number is cited as an example. However, even when the photosensitive drum rotation number or the print number of the image forming apparatus is used as a basis, as described above, the toner deterioration state can be derived.

<10. Count of Toner Consumption Amount by Pixel Count Control>

With respect to the toner consumption amount (amount of the toner used for developing the electrostatic latent image on the photosensitive drum 1) in the image forming region, by pixel count control executed by a controller 15 of the image forming apparatus 100, the toner consumption amount is calculated. The controller 15 of the image forming apparatus 10 for deriving the toner consumption amount by executing the pixel count control corresponds to a developer amount deriving means.

In the current image forming apparatus, as a pulse modulation type, a pulse-width modulation (PWM) type in which a pulse with a width depending on a value of printing dot is generated to control an emission time of laser light is employed in general.

A relationship between a laser emission time when only one printing dot is printed, i.e., the pulse width outputted from a PWM circuit and the amount of the toner consumed for the printed dot is generally linear although it varies depending on a set developing characteristic. For example, in the case where the toner consumption amount when only one printing dot of a certain value is printed alone is X mg, the laser emission time depends on the printing dot value and therefore the toner consumption amount can be calculated by counting the printing dot value.

(Feature of this Embodiment)

In this embodiment, an increment of the residual toner amount obtained from the toner consumption amount calculated depending on the pixel count control and the back-transfer degree estimated (derived) depending on the above-descried toner deterioration state is added. As a result, it becomes possible to estimate the detection of full of the residual toner amount with high accuracy.

First, a calculation formula of the residual toner amount in the case where back-transfer of the respective color toners is not considered is shown.

The residual toner amount of each cartridge is calculated by the following equation.

(Residual toner amount $A$=toner use amount−(toner use amount×transfer efficiency (%)).

By adding the increment of the residual toner amount, obtained from the back-transfer degree, to the residual toner amount A, it is possible to estimate the detection of full of the residual toner with higher accuracy than that of a conventional constitution.

The means for estimating the back-transfer degree from the developing roller rotation number will be described. FIG. 6 is a graph showing the relationship between the developing roller rotation number and the toner transfer rate. From FIG. 6, it is understood that the developing roller rotation number and the toner transfer rate are correlated with each other. Further, as described above, the toner transfer rate and the back-transfer degree are correlated with each other. Therefore, from the developing roller rotation number at the upstream station, the back-transfer degree at the upstream station can be calculated.

The correlation between the developing roller rotation number and the toner transfer rate and between the toner transfer rate and the back-transfer degree is determined by the developing roller and a process speed (PS). The process speed is a rotation speed of the photosensitive drum 1.

For example, in the case where the developing roller has a diameter of 12 mm and the process speed (PS) is 120 mm/sec, the back-transfer degree can be associated with the developing roller rotation number so as to be 1 from the initial rotation to 20,000-th rotation, 2 from 20,001-th rotation to 40,000-th rotation, 3 from 40,001-th rotation to 55,000-th rotation, 4 from 55,001-th rotation to 60,000-th rotation, and 5 from 60,001-th rotation.

Here, when a predetermined image is formed and primary-transferred from the photosensitive drum 1 onto the intermediary transfer belt 6, the amount of the toner per unit area on the intermediary transfer belt 6 in T and the amount of the transfer residual toner on the photosensitive drum 1 after the primary transfer is t. In this case, a transfer efficiency a which is a rate of the toner transferred from the photosensitive drum 1 onto the intermediary transfer belt 6 is represented by $\alpha=T/(T+t)$.

Further, in the case where the toner image transferred from the photosensitive drum 1 of a certain station onto the intermediary transfer belt 6 passes through the downstream station, the amount of the toner moved to the photosensitive drum 1 of the downstream station is tx (x=y, m, c for associated color), and the amount of the toner remaining on the intermediary transfer belt 6 without being moved to the photosensitive drum 1 of the downstream station is Tx (x=y, m, c). In this case, a back-transfer efficiency $\beta x$ can be represented by $\beta x=Tx/(Tx+tx)$. That is, a back-transfer efficiency $\beta y$ at the transfer portion of the downstream image forming portion with respect to the toner subjected to the development at the upstreammost image forming portion Sa can be represented by $\beta y=Ty/(Ty+ty)$. Similarly, back-transfer efficiencies $\beta m$ and $\beta c$ at the transfer portions of the downstream image forming portions with respect to the toners subjected to the development at the downstream image forming portions Sb and Sc can be represented by $\beta m=Tm/(Tm+tm)$ and $\beta c=Tc/(Tc+tc)$. Incidentally, the back-transfer efficiency is another index of the back-transfer degree described above and has the influence on the toner deterioration degree. For that reason, the back-transfer efficiencies $\beta y$, $\beta m$ and $\beta c$ at the respective cartridges are different from each other.

The transfer efficiency $\alpha$ and the back-transfer efficiency $\beta$ are calculated by an experiment before shipping and are stored in a memory (storing means). With respect to the back-transfer efficiency $\beta$, as described later, the memory has a table in which the relationship between a detection result of the developing rotation number at the upstream image forming portion and the back-transfer amount at the downstream image forming portion is stored. The memory is provided, at each of the cartridges, as memories 16*a*, 16*b*, 16*c* and 16*d*.

When the amounts of use of the toners during the image formation at the respective cartridges are $\gamma y$, $\gamma m$, $\gamma c$ and $\gamma k$, the amounts of the residual toners collected in cleaning containers 72*a*, 72*b*, 72*c* and 72*d* are calculated as follows.

$$\gamma y\times(1-\alpha) \quad 72a$$

$$\gamma y\times\alpha\times(1-\beta y)+\gamma m\times(1-\&a) \quad 72b$$

$$\gamma y\times\alpha\times(1-\beta y)^2+\gamma m\times\alpha\times(1-\beta m)+\gamma c\times(1-\alpha) \quad 72c$$

$$\gamma y\times\alpha\times(1-\beta y)^3+\gamma m\times\alpha\times(1-\beta m)^2+\gamma c\times\alpha\times(1-\beta)+\gamma k\times(1-\alpha) \quad 72d$$

Thus, at the upstreammost image forming portion Sa (first image forming portion), on the basis of the information on the developer used for the image formation at the image forming portion Sa, the residual toner amount is calculated. At the downstream image forming portions Sb, Sc and Sd (second image forming portion), on the basis of the information on the developer used for the image formation at the upstream image forming portion (first image forming portion) and the information on the developer used for the image formation at the image forming portion (second image forming portion), the residual toner amount is calculated.

Here, by changing the back-transfer efficiency $\beta$ correspondingly to the back-transfer degrees 1 to 5, weighing of the addition amount is assigned to the total amount of the residual toner, so that the total amount of the residual toner can be calculated with high accuracy.

In order to change the back-transfer efficiency $\beta$ correspondingly to the back-transfer degrees 1 to 5, in the memory, the table storing the relationship between the detection result of the developing roller rotation number at the upstream image forming portion and the back-transfer amount at the downstream image forming portion is stored. In other words, the memory has the table storing the relationship between the detection result of the detecting means for detecting the information on the developer deterioration state at the upstream image forming portion (first image forming portion) and the back-transfer amount of the developer at the downstream image forming portion (second image forming portion).

That is, at the downstream image forming portions (second image forming portions) Sb, Sc and Sd, the toner amount is calculated on the basis of the information on the developer used for the image formation at the upstream image forming portion (first image forming portion), the information on the developer used for the image formation at the image forming portion (second image forming portion), the relationship information stored in the memory and the detection information on the upstream-side toner deterioration.

Further, the residual toner of the secondary transfer from the transfer belt onto the recording material is charged to the positive polarity by the intermediary transfer member cleaning means and is transferred onto and collected by the photosensitive drum 1 at the primary transfer portion of the first station.

In the case where an integrated amount of the residual toner at the first station is estimated as being large, it also becomes possible to intentionally collect the residual toner at another station.

Figure 3:
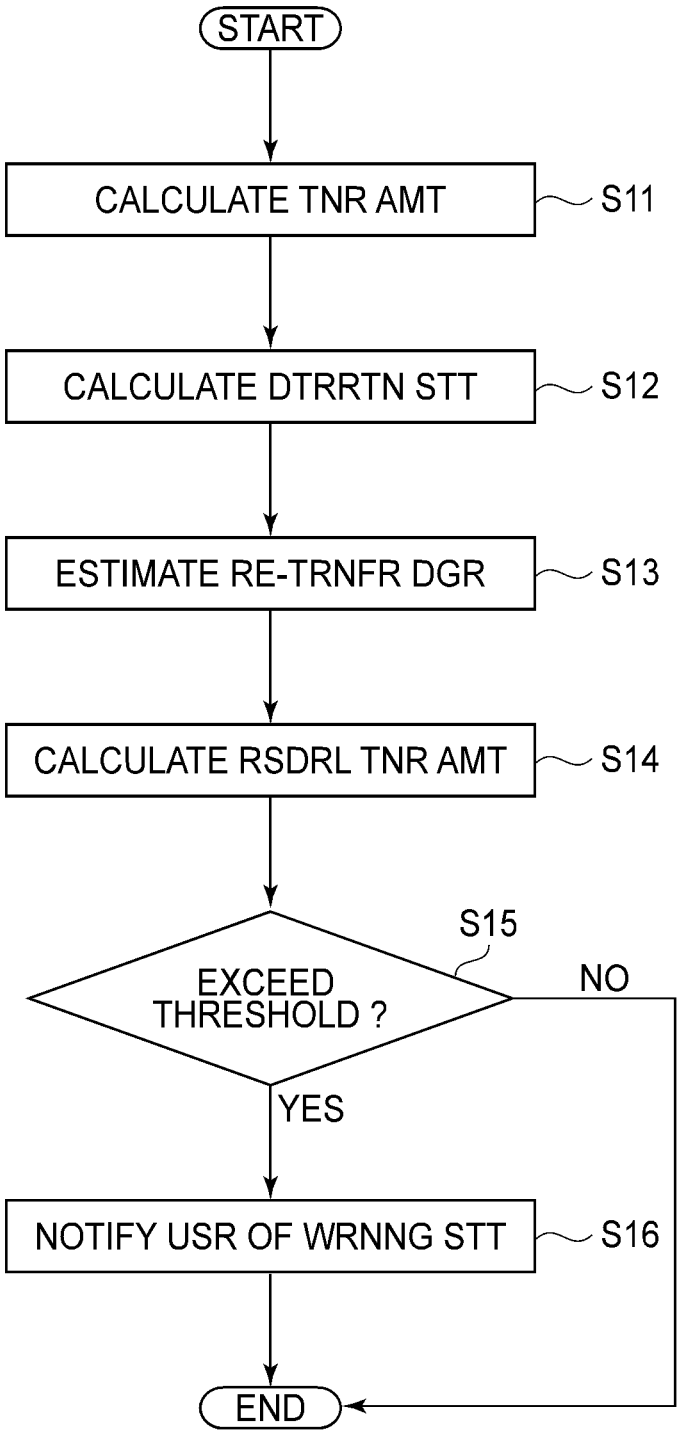
FIG. 3 is a flow chart showing an execution procedure of detection of full(-up) of a residual toner in Embodiment 1.

A method of estimating the residual toner amount in this embodiment will be described. FIG. 3 is a flow chart for illustrating the method of estimating the residual toner amount and showing an executing procedure of detection of full of the residual toner executed by the controller 15 of the image forming apparatus.

First, at each process cartridge, on the basis of the above-descried pixel count control, the amount of use of each color toner is obtained from the image data (image information) of each color component (S11). Then, the toner deterioration state at the process cartridge is calculated from the developing roller rotation number (S12), and from a calculation result of this toner state, the back-transfer degree is estimated by using Table 1 (S13). Then, the residual toner amount on the basis of the back-transfer degree is calculated (S14).

Then, an integrated value of a value obtained by adding the residual toner amount obtained in S14 to the amount of use of each color toner at each process cartridge obtained in S11 is compared with an estimated threshold of a full amount of the residual toner stored in advance in a nonvolatile memory mounted in each process carriage (S15). When this integrated value exceeds the threshold in the nonvolatile memory, the collection toner container 72 is regarded as being filled with the residual toner and then a detection signal is sent. The display portion provided on the image forming apparatus notifies a user of a warning state on the basis of the detection signal (S16). This detection signal corresponds to a detection signal relating to the amount of the developer accommodated in the accommodated container.

For example, in the case where the image forming operation is performed at the first station Sa, the residual toner is (back-)transferred onto the photosensitive drum 1*b* at the adjacent second station Sb located downstream of the first station Sa with respect to the movement direction of the intermediary transfer belt 6. In such a case, the toner deterioration state at the first station Sa is calculated and from its calculation result, the back-transfer amount is estimated. At the second station Sb, the integrated value of the value obtained by adding the residual toner amount (back-transfer amount) on the basis of the back-transfer degree to the toner use amount obtained from the image data is compared with the threshold for detecting the full(-up) of the residual toner. This is true for the case where the image forming operation is performed at the second and third stations Sb and Sc. In the case where the image forming operation is performed at the second and third stations Sb and Sc, the back-transfer of the residual toner is effected at the third and fourth stations Sc and Sd, respectively.

Thus, the residual toner full-up condition detection can be made with high accuracy.

Here, with respect to the photosensitive drum 1*a* at the upstreammost first station Sa with respect to the movement direction of the intermediary transfer belt 6, there is no need to consider the back-transfer and therefore the integrated value of the toner use amount obtained from the image data is compared with the threshold for detecting the full-up condition of the residual toner.

Incidentally, as described above, in the case where the simultaneous transfer and cleaning type is employed, the transfer residual toner remaining on the intermediary transfer belt 6 is transferred back onto the photosensitive drum 1*a* at the first station Sa. The case where the residual toner full-up condition detection is made at the first station Sa in consideration of such a transfer residual toner remaining on the intermediary transfer belt 6 will be described later specifically in Embodiment 2.

Here, in S11, the toner use amount for each color is obtained from the image data of each color component but may also be obtained on the basis of the number of image forming operations (image formation number) at each process cartridge.

Further, in S13, when the back-transfer degree is estimated in this embodiment, the relationship shown in Table 1 is used but the present invention is not limited thereto. The relationship may only be required that it is stored in advance and uses relation between the toner deterioration state and the degree of the back-transfer. Further, in S14, the residual toner amount may also be derived, on the basis of the back-transfer degree estimated in S13, from the preliminarily stored relationship between the degree of the back-transfer and the back-transfer amount. Here, the controller 15 of the image forming apparatus executing the operation in S13 corresponds to a back-transfer degree deriving means, and the controller 15 of the image forming apparatus executing the operation in S14 corresponds to a back-transfer amount deriving means.

As described above, this embodiment is characterized in that the degree of use of each station is detected and the toner deterioration state is calculated and thereafter the back-transfer amount at the downstream station is derived. As a result, the residual toner amount at each station can be estimated with a high degree of accuracy, so that it becomes possible to detect a residual toner filled condition with high accuracy. Incidentally, in this embodiment, the controller 15 notifies the user of the warning at the display portion on the basis of the detection signal but this may also be applicable to other embodiments. For example, the controller 15 may notify the user of the warning detection signal at a terminal connected via network or may stop the image forming operation on the basis of the detection signal.

Incidentally, in this embodiment, as the image forming apparatus, such an image forming apparatus using the simultaneous transfer and cleaning effected after the residual toner transfer onto the intermediary transfer belt 6 is effected and then the secondary transfer is effected is described but the present invention is not limited thereto. That is, as the image forming apparatus, it is also possible to use an image forming apparatus of an in-line type in which the recording material carried on a recording material conveying belt (transfer belt) is conveyed and onto which color toner images are directly and successively transferred superposedly from the plurality of image bearing members. In this case, the back-transfer refers to a phenomenon that the toner images transferred on the recording material carried by the transfer belt are (back-) transferred onto and removed by the photosensitive drum when the toner images pass through the downstream process station.

Also with respect to the image forming apparatus of such a type, by applying the present invention, an effect similar to that described above can be obtained.

Further, as a means for collecting the transfer residual toner on the intermediary transfer belt or the transfer belt, the means is not limited to those described above but may also be a direct collecting means such as a blade or the like.

[Embodiment 2]

Next, an image forming apparatus in another embodiment (Embodiment 2) of the present invention will be described. With respect to the basic structure and operation, this image forming apparatus is the same as the above described image forming apparatus in Embodiment 1 of the present invention. Thus, the elements of this image forming apparatus, which are the same as, or equivalent in, function and structure as the counterparts in the image forming apparatus in Embodiment 1, will be represented by the same reference numerals or symbols as those in Embodiment 1 and will be omitted from detailed description.

In this embodiment, the toner deterioration state is calculated from the degree of use of each process cartridge and on the basis of the back-transfer amount derived from a calculation result, a total amount of the residual toner at each process cartridge is calculated. Then, depending on the total amount of the residual toner, the process cartridges are appropriately destined for the collection of the transfer residual toner from the intermediary transfer belt 6.

By employing such a constitution, it is possible to prevent the transfer residual toner on the intermediary transfer belt 6 from being locally collected in the collection toner container 72 in a certain process cartridge, so that the plurality of collection toner containers 72 can be effectively used more efficiently.

<Destination Control of Transfer Residual Toner>

Destination control of the transfer residual toner on the intermediary transfer belt 6 will be described below.

Part (a) of FIG. 8 is a schematic sectional view for illustrating the destination control of the transfer residual toner on the intermediary transfer belt 6 executed by the controller 15 of the image forming apparatus in this embodiment.

The transfer residual toner on the intermediary transfer belt 6 to which the proper positive electric charge is imparted is transferred back onto and collected by the photosensitive drum 1*a* at the primary transfer portion N1*a* of the first station Sa in Embodiment 1.

However, at the primary transfer portion N1*a*, by applying the negative bias (voltage), it is possible to pass through the primary transfer portion N1*a* without collecting the transfer residual toner at the first station Sa.

Then, at a described station where the transfer residual toner is intended to be collected, by applying the positive bias (voltage) to the associated primary transfer portion, the transfer residual toner on the intermediary transfer belt 6 can be collected at the desired process cartridge.

In this embodiment, similarly as in Embodiment 1, the back-transfer degree at the downstream station is obtained on the basis of the toner deterioration degree at the upstream station to calculate the residual toner amount at each state with accuracy. Then, on the basis of the residual toner amount, the transfer residual toner on the intermediary transfer belt 6 is preferentially destined for the station where the residual toner amount is small.

Here, the determination of the destination of the transfer residual toner on the intermediary transfer belt 6 is, in the case where the back-transfer degree is taken into consideration, effectively made by selecting the station from the second to fourth stations Sb to Sd other than the upstreammost first station Sa with respect to the movement direction of the intermediary transfer belt 6. In this embodiment, also in view of the productivity (operation efficiency), the transfer residual toner on the intermediary transfer belt 6 is destined for the cartridge for collecting the transfer residual toner correspondingly to the operation in the sheet passing mode. The transfer residual toner destination control in each of the case where the print job is performed in an operation in a continuous sheet passing mode and the case where the print job is performed in an operation in an intermittent sheet passing mode will be described. In the continuous sheet passing mode, the image forming operation is performed continuously on the plurality of sheets, and with respect to the recording material subjected to the image forming operation, a subsequent recording material to be subjected to the image forming operation is present.

In the case where the print job is performed in the operation in the continuous image forming mode, as a bias (transfer bias) applied to the transfer portion of the process station, the positive bias is applied to all the stations.

As a result, all the transfer residual toners by the secondary transfer can be collected at the first station Sa.

By employing such a constitution, simultaneously with the primary transfer of the toner image for a subsequent page, the cleaning of the intermediary transfer member on which the transfer residual toner with respect to the current page can be effected, so that it becomes possible to continuously from the image without lowering the process speed of the image forming apparatus.

Further, in the case where the print job is performed in the operation in the intermittent sheet passing mode, during post-rotation of the photosensitive drum after the end of the image forming operation, the transfer residual toner is collected at the station, of the second to fourth stations Sb to Sd, where the back-transfer degree is smallest, i.e., at the station where the addition amount of the residual toner is smallest. In this case, at the first station Sa, the bias applied to the transfer portion is the negative bias to prevent the transfer residual toner on the intermediary transfer belt 6 from being collected by the photosensitive drum 1*a*. By such a constitution, at the second to fourth stations Sb to Sd, in order to uniformly move the transfer residual toner to these stations, the bias applied to each transfer portion is changed in real time, so that passing or collection of the transfer residual toner can be selected.

A method of estimating the residual toner amount in this embodiment is as follows. FIG. 7 is a flow chart for illustrating the destination of the transfer residual toner and the method of estimating the residual toner amount and showing an executing procedure of detection of full of the residual toner executed by the controller 15 of the image forming apparatus.

From the calculation result of the toner deterioration state in the process cartridge at each station until the residual toner amount is estimated, the procedure is the same as that in Embodiment 1 and therefore will be omitted from description (S11 to S14).

Then, on the basis of the residual toner amount, the station for which the transfer residual toner is destined is determined (S21). As the station for which the transfer residual toner is destined, the station where the residual toner amount is small is preferentially selected. Then, at each cartridge, the total amount of the residual toner is calculated. That is, the integrated value of the sum of the amount of use of each color toner obtained from the image data (image information), the residual toner amount on the basis of the back-transfer degree and the amount of the destined transfer residual toner is obtained (S22). Here, the transfer residual toner amount is, on the basis of the toner deterioration state, determined by the controller 15 (corresponding to a belt residual developer amount deriving means) of the image forming apparatus from the relationship between the preliminarily stored toner deterioration state and the residual toner amount. The toner deterioration state can be, as described in Embodiment 1, derived from, e.g., the developing roller rotation number. In order to derive the transfer residual toner amount with high accuracy, in addition to the toner deterioration state, the amount of use of the toner may be used.

On the basis of the above-descried pixel count control, the amount of use of each color toner is obtained from the image data (image information) of each color component and then the transfer residual toner amount can be calculated from the toner use amount and the toner deterioration state.

Then, the above-described integrated value is compared with an estimated threshold of full of the residual toner stored in advance in a nonvolatile memory mounted in each process carriage (S15). When this integrated value exceeds the threshold in the nonvolatile memory, the collection toner container 72 is regarded as being filled (full-up) with the residual toner and then the display portion provided on the image forming apparatus notifies a user of a warning state (S16). Incidentally, in this embodiment, the controller 15 notifies the user of the warning at the display portion on the basis of the detection signal but may also be applicable to other embodiments. For example, the controller 15 may notify the user of the warning belt the detection signal at a terminal connected via network or may stop the image forming operation on the basis of the detection signal.

Here, with respect to the photosensitive drum 1*a* at the first station Sa, there is no need to consider the back-transfer and therefore the integrated value of the sum of the toner use amount obtained from the image data and the amount of the transfer residual toner collected in the operation in the continuous sheet passing is compared with the threshold for the residual toner full-up condition detection.

In summary, in the image forming apparatus in which the toner is collected from the intermediary transfer belt 6 onto the photosensitive drum 1, at the upstreammost station Sa (first image forming portion), the total amount of the residual toner is calculated on the basis of the amount of the residual toner resulting from the image formation at the station Sa and the amount of the toner collected from the intermediary transfer belt 6 onto the photosensitive drum 1*a*.

On the other hand, at the second to fourth stations (second image forming portion), as in Embodiment 1, the total amount of the residual toner is calculated on the basis of the residual toner amount obtained in view of the back-transfer amount of the toner at the upstreammost station (first image forming portion) and the amount of the toner collected from the intermediary transfer belt 6 onto the photosensitive drums 1*b*, 1*c* and 1*d*.

Here, by the bias applied to the transfer portion, the destination of the transfer residual toner can be changed but, the passing or collection of the transfer residual toner may also be selected by physically separating the intermediary transfer belt and each photosensitive drum from each other.

Part (b) of FIG. 8 is a schematic sectional view for illustrating the destination control in the cartridges provided with a contact and separation means.

In the image forming apparatus in this embodiment, at the station where the transfer residual toner on the intermediary transfer belt 6 is intended to be passed through the transfer portion, the intermediary transfer belt and the photosensitive drum are physically spaced by the contact and separation means. Then, at the station where the transfer residual toner is intended to be collected from the intermediary transfer belt 6, the intermediary transfer belt and the photosensitive drum are physically contacted by the contact and separation means, so that it is possible to effect control of the collection of the transfer residual toner at a desired station.

Thus, in this embodiment, in the image forming apparatus using the simultaneous transfer and cleaning, the degree of use of the process cartridge is detected and then the toner deterioration state is calculated. Thereafter, on the basis of the calculation result, the back-transfer degree at the downstream station is estimated and then on the basis of the estimation result, the cartridge in which the transfer residual toner is collected from the intermediary transfer belt 6 is selected in real time.

By employing such a constitution, it is possible to prevent the transfer residual toner on the intermediary transfer belt 6 from being locally collected in the collection toner container 72 (residual toner container) in a certain process cartridge, so that the plurality of collection toner containers 72 can be effected used more efficiently.

Incidentally, also in this embodiment, the image forming apparatus using the intermediary transfer belt 6 is described but the present invention is not limited thereto. It is also possible to use an image forming apparatus of an in-line type in which the recording material is carried and conveyed by using on a recording material conveying belt (recording material conveying member) and then color toner images are directly and successively transferred superposedly from the plurality of image bearing members onto the recording material. In the case of the operation in the continuous sheet passing mode in such an image forming apparatus which is not of the simultaneous transfer and cleaning, at a sheet interval between consecutive sheets subjected to the continuous image formation, the removal of the transfer residual toner on the belt is effected.

Incidentally, as a means for collecting the transfer residual toner on the intermediary transfer belt or the transfer belt, the means is not limited to those described above but may only be required that the transfer residual toner is collected by the photosensitive drum.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 139657/2011 filed Jun. 23, 2011 and 129774/2012 filed Jun. 7, 2012, which is hereby incorporated by reference.

What is claimed is:

1. An image forming apparatus comprising:

a plurality of image forming portions each including an image bearing member, a developing device for developing into a developer image an electrostatic latent image formed on the image bearing member, and a cleaning device for collecting in an accommodating container a developer remaining on the image bearing member after the developer image is transferred, wherein said plurality of image forming portions are provided along a movement direction of a recording material conveying member for conveying a recording material onto which the developer image is to be transferred or an intermediary transfer member onto which the developer image is to be transferred, and include a first image forming portion and a second image forming portion provided downstream of the first image forming portion with respect to the movement direction of the recording material conveying member or the intermediary transfer member;

detecting means for detecting information on a developer deterioration state at the first image forming portion;

storing means for storing a relationship between a detection result of said detecting means and an amount of developer to be back-transferred at the second image forming portion; and an outputting device for outputting a signal relating to an amount of developer accommodated in the accommodating portion at the second image forming portion on the basis of a detection result of said detecting means, the relationship stored in said storing means, information on a developer used for image formation at the first image forming portion, and information on a developer used for image formation at the second image forming portion.

2. An apparatus according to claim 1, wherein developer remaining on the recording material conveying member or the intermediary transfer member is transferred onto the image bearing member at the second image forming portion and is collected in the accommodating container at the second image forming portion, and wherein said outputting device outputs the signal relating to the amount of the developer accommodated in the accommodating container at the second image forming portion further on the basis of information on an amount of the developer collected in the accommodating container at the second image forming portion.

3. An apparatus according to claim 1, wherein the first image forming portion of said plurality of image forming portions is provided at an upstreammost position with respect to the movement direction of the recording material conveying member or the intermediary transfer member, and wherein said outputting device outputs a signal relating to an amount of the developer accommodated in the accommodating container at the first image forming portion on the basis of the information on the developer used for image formation at the first image forming portion.

4. An apparatus according to claim 3, wherein developer remaining on the recording material conveying member or the intermediary transfer member is transferred onto the image bearing member at the first image forming portion and is collected in the accommodating container, and wherein said outputting device outputs the signal relating to the amount of the developer accommodated in the accommodating container at the first image forming portion further on the basis of information on an amount of the developer collected in the accommodating container at the first image forming portion.

5. An apparatus according to claim 1, wherein developer remaining on the recording material conveying member or the intermediary transfer member is, after amounts of developers accommodated in the accommodating containers at said plurality of image forming portions are compared, preferentially collected at the image forming portion where the amount of the developer accommodated in the accommodating container is smallest.

6. An apparatus according to claim 1, wherein the developing device includes a developing roller, provided opposed to the image bearing member, for developing the electrostatic latent image, and wherein said detecting means detects a rotation number of the developing roller.

7. An apparatus according to claim 1, wherein said detecting means detects a rotation number of the image bearing member.

8. An apparatus according to claim 1, wherein said detecting means detects a number of times of image formation.

9. An apparatus according to claim 1, further comprising a display portion for displaying information, wherein said display portion displays a warning state on the basis of the signal.

10. An apparatus according to claim 1, wherein said outputting device stops an image forming operation of said image forming apparatus on the basis of the signal.

* * * * *